United States Patent [19]

Craig

[11] 4,089,291

[45] May 16, 1978

[54] WATERCRAFT

[76] Inventor: Robert W. Craig, 6343 E. Via Estrada, Anaheim Hills, Calif. 92807

[21] Appl. No.: 782,249

[22] Filed: Mar. 28, 1977

[51] Int. Cl.[2] ..... B63B 35/72

[52] U.S. Cl. ..... 115/70

[58] Field of Search ..... 115/70, 18 E, 22, 26; 114/61, 63, 283, 291, 292; 9/2 R, 2 S, 7, 310 C, 310 R; D12/62, 69

[56] References Cited

U.S. PATENT DOCUMENTS

| | | | |
|---|---|---|---|
| 2,751,876 | 6/1956 | Ogilvie | 115/22 |
| 2,919,392 | 12/1959 | Smith | 115/18 E |
| 3,646,905 | 3/1972 | Martinmaas | 115/70 |
| 3,695,211 | 10/1972 | Gross | 115/26 |
| 3,726,249 | 4/1973 | Watkins | 115/70 |
| 3,791,335 | 2/1974 | Del Vecchio | 115/70 |
| 3,883,909 | 5/1975 | Fisher et al. | 114/61 X |

*Primary Examiner*—Robert B. Reeves
*Assistant Examiner*—Edward M. Wacyra
*Attorney, Agent, or Firm*—William W. Haefliger

[57] ABSTRACT

A pleasure craft comprises forwardly elongated, laterally spaced apart floats; a platform over the floats and attached to them; a seat on the platform, with the platform defining leg spaces for the user; and a power unit carried by the platform forwardly of the seat. The power unit includes a propeller below the platform and generally vertically below a manual control which is above the platform.

10 Claims, 8 Drawing Figures

WATERCRAFT

BACKGROUND OF THE INVENTION

This invention relates generally to pleasure watercraft, and more particularly concerns a small sized, powered, highly maneuverable, portable water vehicle.

Related prior art craft include surfboards, floats, small catamarans and similar devices. None of these, to my knowledge, embody the unusual combinations and sub-combinations of structure, mode of operation and results as are now afforded by the present invention.

SUMMARY OF THE INVENTION

It is a major object of the invention to provide a recreational watercraft characterized by a high degree of stability and maneuverability, ease of operation, safety, and simplicity of construction facilitating disassembly and portability. Fundamentally, the craft comprises a. two generally longitudinally and horizontally forwardly elongated floats which are laterally spaced apart, the floats having shallow draft, b. a horizontal platform overlying the floats and spaced thereabove, the platform attached to the floats, the platform also extending generally horizontally, c. a seat on the platform overlying the space between the floats and having an upright back facing forwardly, the platform being cut away generally forwardly of the seat to provide leg spaces through which upper portions of the floats are vertically accessible, and d. a power unit carried by the platform and extending vertically, the unit including a manual control forwardly of the seat and a propulsion means located below the level of the floats, said control being manually manipulable to rotate the propulsion means about a vertical axis defined by the unit.

As will appear, the platform may be removably attached to the floats, and the seat removably attached to the platform, whereby the craft may be easily disassembled and transported as by a land vehicle; the floats may comprise simple foamed plastic bodies having substantially flat bottoms, with downward projecting blunt stabilizers located rearwardly of the seat, to facilitate maneuvering; the platform may define laterally extending wings overlying the floats, forwardly of the leg spaces, to provide foot rests; the platform and floats may have a very low profile, in elevation and with the seat removed to enable stacking of multiple such sub-combinations, for transport; and the power unit may include a vertical shaft removably attached to the platform and projecting through a hole in the forwardly elongated stem portion of the platform between the leg spaces, there being a steering element on the upper end of the shaft and a propulsion means at the lower end of the shaft, the unit being fully rotatable to facilitate steering.

These and other objects and advantages of the invention, as well as the details of an illustrative embodiment, will be more fully understood from the following description and drawings, in which:

DRAWING DESCRIPTION

DETAILED DESCRIPTION

Figure 1:
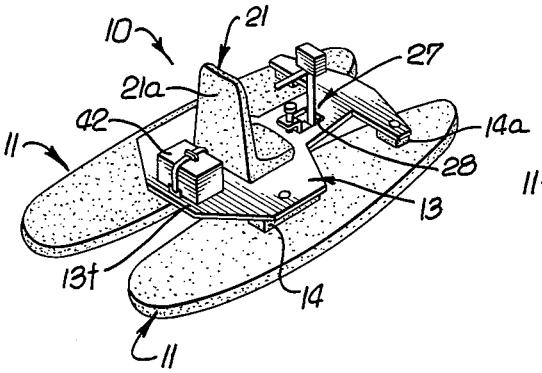
FIG. 1 is a perspective view of a watercraft embodying the invention.
Figure 3:
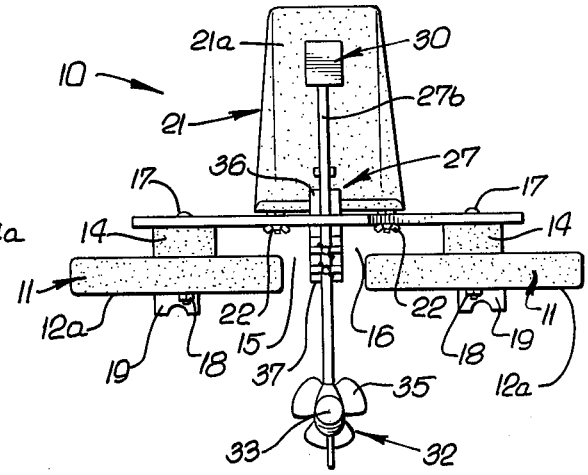
FIG. 3 is a front elevational view taken on lines 3—3 of FIG. 2.

In the drawings the watercraft 10 includes two generally longitudinally and horizontally forwardly elongated floats 11 which are laterally spaced apart. The floats have shallow draft, for quick maneuverability and may have laterally elongated, approximately rectangular cross sections in vertical lateral planes, as is clear from FIG. 3. The floats also have like outlines, in plan, each outline being generally oval shaped but tapering forwardly from loci 12 about ⅔ of the fore to aft length of each float; i.e., the laterally widest part of each float is aft from the mid-length point of the float. As a result, the floats in plan view resemble surfboards. The floats may consist of foamed plastic material, as for example styrofoam, or other plastic.

Figure 2:
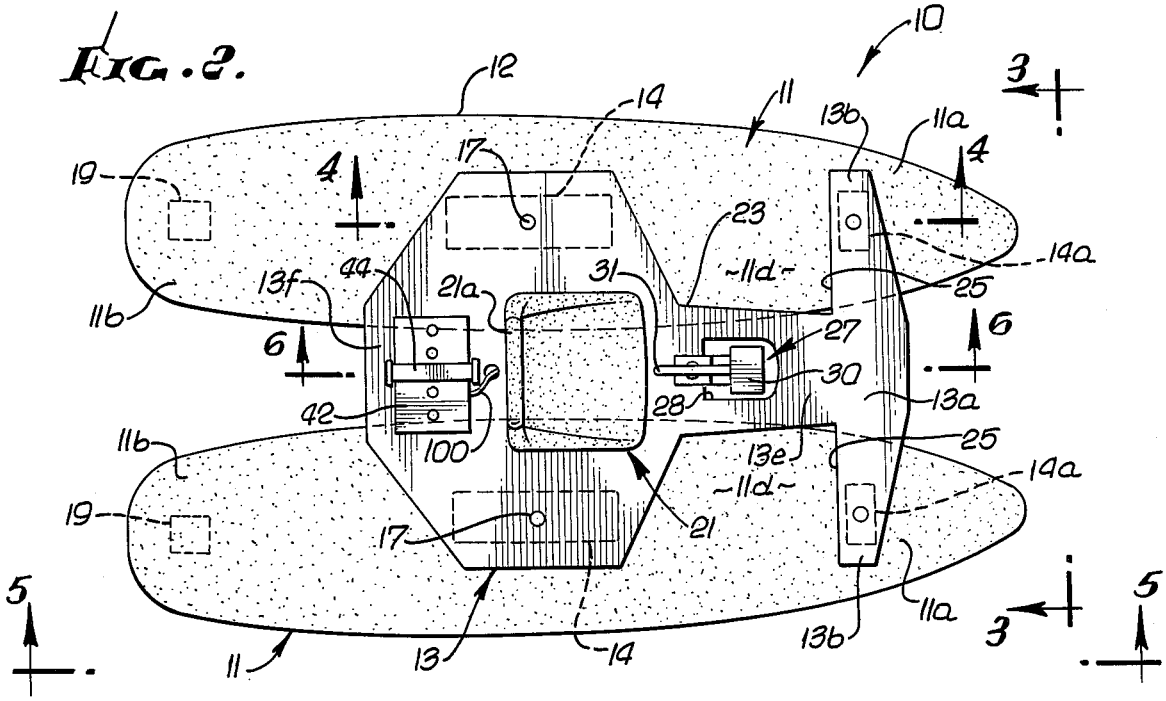
FIG. 2 is an enlarged top plan view of the FIG. 1 watercraft.
Figure 4:
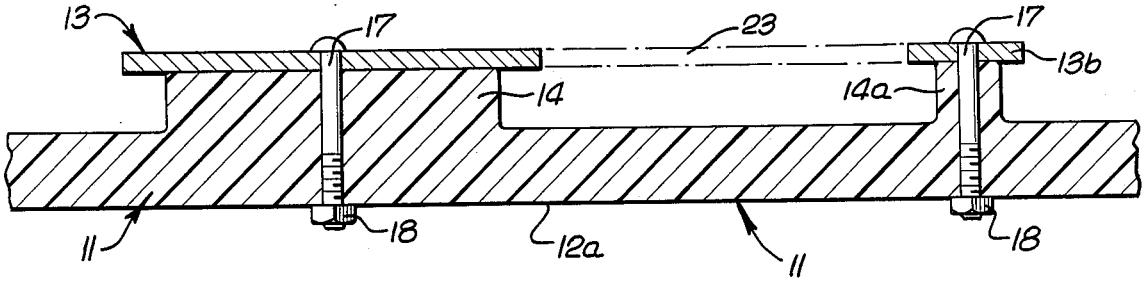
FIG. 4 is an enlarged elevation, in section, on lines 4—4 of FIG. 2.
Figure 5:
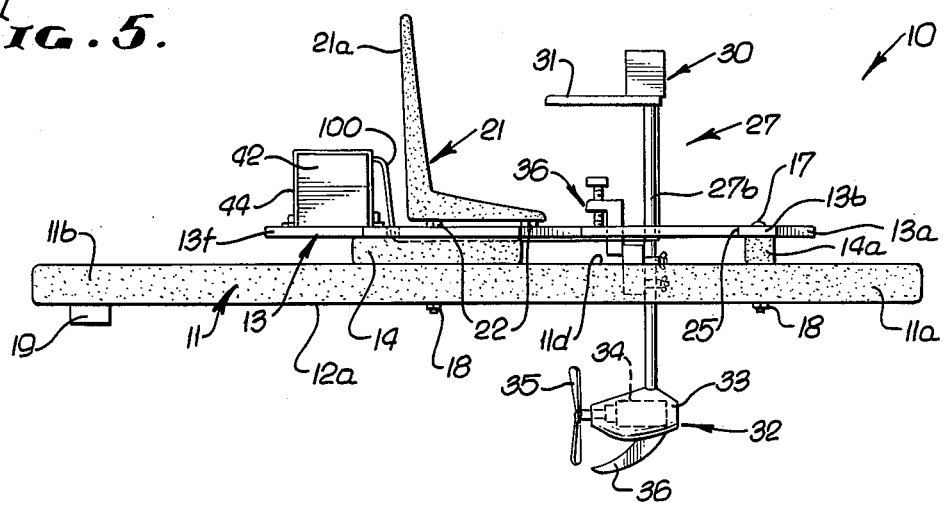
FIG. 5 is a side elevation on lines 5—5 of FIG. 2.
Figure 6:
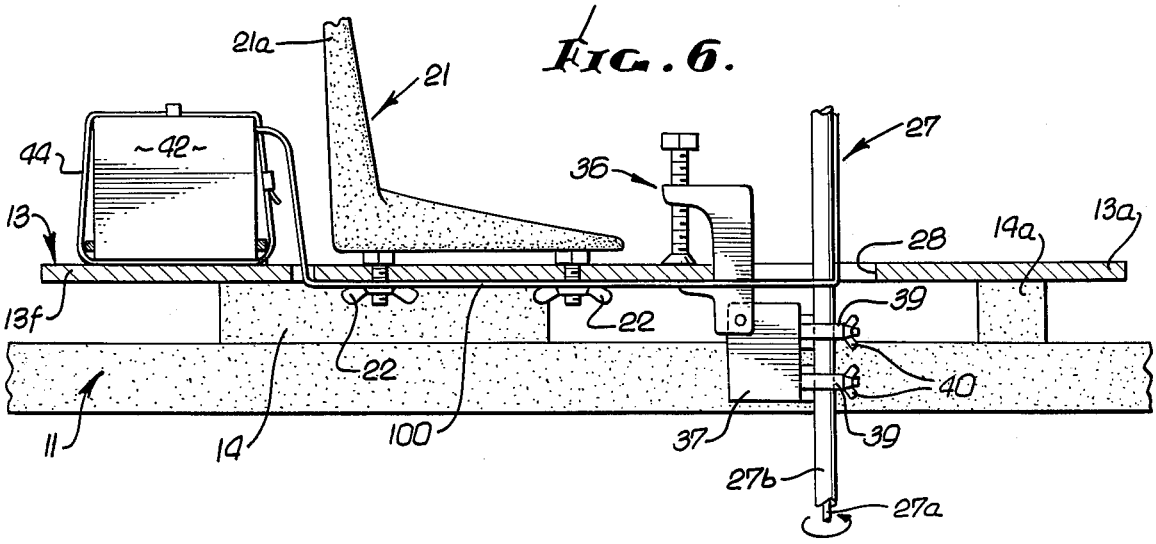
FIG. 6 is an enlarged elevation taken in section on lines 6—6 of FIG. 2.

A horizontal platform 13 overlies mid-portions of the floats and is spaced above them, as for example as facilitated by the provision of plastic spacers 14 located centrally of the floats as is clear from FIG. 2. A forward platform portion **13*a* includes wings 13*b* overlying forward portions 11*a* of the floats and spaced thereabove as by spacers 14*a* located forwardly of spacers 14. Each float and its associated spacer typically has inverted T-shape, as is clear from FIG. 3, whereby there is abundant space 15 and 16 between the floats and between the spacers to rearwardly pass waves, beneath the platform and over the major extents of the floats with minimum resistance. Vertical fasteners, such as bolts 17 and nuts 18** extending through the platform, spacers and floats. The spacers may be integral with the floats.

The floats typically have horizontally flat bottoms **12*a*, and blunt stabilizers 19 typically are provided to project beneath the rearward portions 11*b* of the floats, beneath such flat bottoms. Such stabilizers resist turning of the rearward portions of the floats in the water, whereby the forward portions 11*a*** may be more easily turned to steer the watercraft.

The craft includes a seat 21, which may be of one-piece construction and releasably attached to the platform, as by fasteners 22. The seat extends over the space 15 between the floats, and has an upright back **21*a* facing forwardly. The platform is cut away at laterally spaced locations 23 forwardly of the seat to provide leg spaces through which the upper portions 11*d* of the floats are accessible to the user's legs. He may also place his feet against the edges 25 of the wings 13*b***, which provide foot rests.

A power unit 27 is carried by the platform 13, as for example by the narrowed stretch **13*e* forwardly of the seat which also defines a vertical opening 28 through which the unit projects vertically. The unit includes a vertical shaft 27*a*; a head 30 at the top end of the shaft and an associated manual control 31; and a propulsion means as at 32 located below the level of the floats. Means 32 may for example include a housing 33, an electric motor 34 therein, and a propeller 35** driven by the motor. Note also the stabilizer 36. Shaft 27*a* is typically turned about its vertical axis by manual manipulation of steering control 31, to turn the propeller 35 so that the direction of propulsion may be simply controlled, as for example in any azimuthal direction. A clamp 36 removably attached to the platform 13 carries the unit 27, as by a holder 37 carrying holders 39 for a sleeve 27*b* receiving shaft 27*a*. The sleeve may be height adjusted, after loosening of set screw type fasteners 40, which are then tightened against the sleeve. Current from a battery 42 powers the motor, and a line 100 to the motor may extend within or adjacent shaft 27*a*. The battery is removably attached, as by strap 44, to the portion 13*f* of the platform, rearward of the seat. Other types of propulsion units can be employed, if desired.

Figure 7:
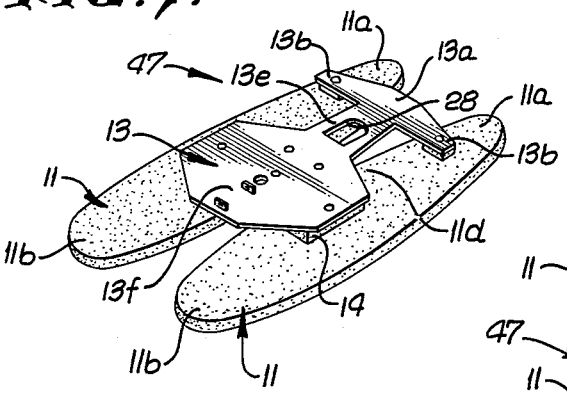
FIG. 7 is a view like FIG. 1, but with the battery and seat removed.
Figure 8:
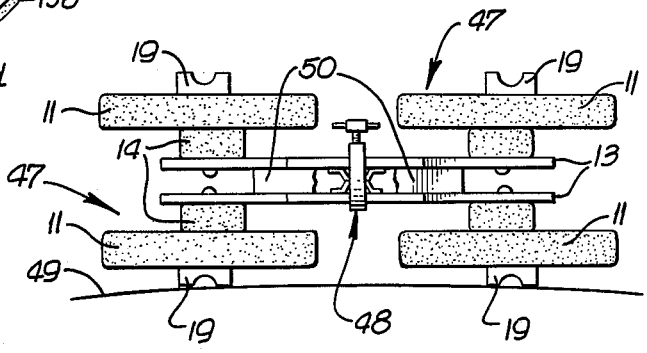
FIG. 8 is an elevation showing stacking of sub-assemblies, as shown in FIG. 7, for transport.

FIG. 7 shows the floats and platform after all other equipment is removed. Such sub-assemblies 47 may be stacked, and clamped at 48, as in FIG. 8, for transport on a carrier such as the roof 49 of an automobile. Note spacers 50 used between the platforms or decks 13, in FIG. 8.

I claim:

1. In a watercraft, the combination comprising a. two generally longitudinally and horizontally forwardly elongated floats which are laterally spaced apart, the floats having shallow draft, b. a horizontal platform overlying the floats and spaced thereabove, the platform removably attached to the floats, the platform also extending generally horizontally, c. a seat on the platform overlying the space between the floats and having an upright back facing forwardly, the platform being cut away generally forwardly of the seat to provide leg spaces through which upper portions of the floats are vertically accessible, and d. a generally vertically elongated power unit carried by the platform generally forwardly of the seat and extending generally vertically, there being structure removably attached to the platform forwardly of the seat and carrying the unit, the unit including a manual control forwardly of the seat above the platform and a propulsion means located below the level of the floats and generally vertically below said control and platform, said control being manually manipulable to rotate the propulsion means about a vertical axis defined by the unit.

2. The combination of claim 1 including certain fasteners removably attaching the platform to the floats.

3. The combination of claim 2 including other fasteners removably attaching the seat to the platform.

4. The combination of claim 1 wherein the platform has a portion that projects rearwardly of the seat, and including a battery carried by said portion, said propulsion means including an electrical motor connected with the battery.

5. The combination of claim 1 wherein the platform includes laterally extending wings overlying the floats forwardly of the leg spaces, said wings providing foot rests.

6. The combination of claim 1 wherein the floats and platform have a low profile, in elevation, the height of which profile is less than the maximum lateral width of each float, whereby multiple of said float and platform combinations may be stacked for transport after removal of the seats.

7. The combination of claim 1 wherein said power unit includes vertical structure removably clamped to a forwardly extending portion of the platform between said leg spaces, said portion containing a vertical through opening passing said structure.

8. In a watercraft, the combination comprising a. two generally longitudinally and horizontally forwardly elongated floats which are laterally spaced apart, the floats having shallow draft, b. a horizontal platform overlying the floats and spaced thereabove, the platform attached to the floats, the platform also extending generally horizontally, c. a seat on the platform overlying the space between the floats and having an upright back facing forwardly, the platform being cut away generally forwardly of the seat to provide leg spaces through which upper portions of the floats are vertically accessible, and d. a power unit carried by the platform and extending generally vertically, the unit including a manual control forwardly of the seat and a propulsion means located below the level of the floats, said control being manually manipulable to rotate the propulsion means about a vertical axis defined by the unit, e. there being spacers between the floats and platform, each float and its associated spacer having inverted T-shaped profile when viewed horizontally rearwardly, in elevation.

9. The combination of claim 8 wherein the floats have horizontally flat bottoms, and including blunt stabilizers projecting below said flat bottoms, rearwardly of the seat.

10. In a watercraft, the combination comprising a. two generally longitudinally and horizontally forwardly elongated floats which are laterally spaced apart, the floats having shallow draft, b. a horizontal platform overlying the floats and spaced thereabove, the platform attached to the floats, the platform also extending generally horizontally, c. a seat on the platform overlying the space between the floats and having an upright back facing forwardly, the platform being cut away generally forwardly of the seat to provide leg spaces through which upper portions of the floats are vertically accessible, and d. a power unit carried by the platform and extending generally vertically, the unit including a manual control forwardly of the seat and a propulsion means located below the level of the floats, said control being manually manipulable to rotate the propulsion means about a vertical axis defined by the unit, e. said platform including laterally extending wings overlying the floats forwardly of the leg spaces, said wings providing foot rests, f. there being spacers between the wings and the floats, said wings attached to the floats via said spacers, said spacers and the floats having inverted T-shape, in elevation.

* * * * *